US012672681B2

(12) United States Patent
Brandt et al.

(10) Patent No.: US 12,672,681 B2
(45) Date of Patent: Jul. 7, 2026

(54) FASTENER CLAMP FOR ATTACHMENT TO TEXTILES

(71) Applicant: NIKE, Inc., Beaverton, OR (US)

(72) Inventors: Baron C. Brandt, Portland, OR (US); Amy L. Toth, Portland, OR (US); Tara Pennington, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 3 days.

(21) Appl. No.: 18/217,716

(22) Filed: Jul. 3, 2023

(65) Prior Publication Data

US 2024/0008559 A1 Jan. 11, 2024

Related U.S. Application Data

(60) Provisional application No. 63/358,433, filed on Jul. 5, 2022.

(51) Int. Cl.
*A41C 3/00* (2006.01)

(52) U.S. Cl.
CPC ..... *A41C 3/0028* (2013.01); *Y10T 24/4081* (2015.01)

(58) Field of Classification Search
CPC ..... Y10T 24/4081; Y10T 24/45225; Y10T 24/45796; A41C 3/0028; A41F 1/006;
(Continued)

(56) References Cited

U.S. PATENT DOCUMENTS 3,484,907 A * 12/1969 Elsenheimer ..... A41F 1/006 24/DIG. 42
8,302,269 B2 * 11/2012 Pitman ..... A41F 1/006 24/666
(Continued)

FOREIGN PATENT DOCUMENTS

GB 2420586 A 5/2006
JP 59-225002 A 12/1984
(Continued)

OTHER PUBLICATIONS

International Search Report and Written Opinion received for PCT Patent Application No. PCT/US2023/026929, mailed on Sep. 18, 2023, 16 pages.

*Primary Examiner* — Jason W San
*Assistant Examiner* — Louis A Mercado
(74) *Attorney, Agent, or Firm* — SHOOK, HARDY & BACON L.L.P.

(57) ABSTRACT

This application is related to a clamp that can provide, for an associated fastener (e.g., hook and receiver or other male/female style fastener), a robust connection to a textile (e.g., a strap or other textile portion that is releasably attachable to another textile portion). For example, the fastener can include a first connector (e.g., hook) for releasably mating with a corresponding second connector (e.g., receiver). In addition, the first connector can include a clamp for providing a fixed connection to a first textile, and the second connector can include a clamp for providing a fixed connection to another textile (e.g., the first and second textiles to be releasably connected to each other via the fastener). In at least some examples, the clamp can include a first clamping plate and a second clamping plate. In addition, a portion of the textile can be secured in a clamping groove between the first clamping plate and the second clamping plate. For instance, the clamping plates can be bonded and/or stitched to the textile portion.

18 Claims, 3 Drawing Sheets

(58) Field of Classification Search
CPC ..... A44B 13/0052; A44B 11/2588; A44B 11/006; A44B 11/258; A44B 11/2584; A44B 13/0029; A44B 13/0076
USPC ..... 450/58, 79
See application file for complete search history.

(56) References Cited

U.S. PATENT DOCUMENTS

| | | | | |
|---|---|---|---|---|
| 8,935,835 | B2 * | 1/2015 | Fildan | H01F 7/0263 24/669 |
| 10,314,370 | B2 * | 6/2019 | Brandt | A44B 11/2588 |
| 10,499,698 | B2 * | 12/2019 | Fildan | A41F 1/006 |
| 10,668,413 | B2 * | 6/2020 | Cole | F16G 3/07 |
| 10,701,998 | B2 * | 7/2020 | Fildan | A41F 1/04 |
| 2017/0135429 | A1 * | 5/2017 | Fildan | A41F 1/006 |

FOREIGN PATENT DOCUMENTS

| | | | |
|---|---|---|---|
| JP | 2001-46119 | A | 2/2001 |
| WO | 2009/034378 | A2 | 3/2009 |

* cited by examiner

FASTENER CLAMP FOR ATTACHMENT TO TEXTILES

CROSS REFERENCE TO RELATED APPLICATIONS

This application claims the priority benefit of U.S. Application No. 63/358,433 (filed Jul. 5, 2022), which is incorporated herein by reference in its entirety.

BACKGROUND

Fasteners are used in various articles (e.g., garments, apparel, clothing, belts, footwear, fitness or athletic equipment, bags, etc.) to connect two or more portions together. For example, fasteners can be used to connect portions (e.g., straps) of a support garment, connect ends of belt, secure a footwear article, and the like. Often fasteners include two connectors that releasably mate with one another, and each connector is fixedly secured to a respective portion of the article. For example, fasteners can include a hook and receiver or some other combination of male/female connectors.

In some instances, the fixed connection between a connector and a textile portion is not sufficiently robust to withstand repeated wear, washing, etc., such that the fixed connection can fail. In some instances, the fixed connection can be resource intensive (e.g., time, materials, cost, etc.) to manufacture. In some instances, the fixed connection and/or other portions of the fastener can be arranged close to the wearer, which can cause irritation, hotspots, or other discomfort.

DETAILED DESCRIPTION OF DRAWINGS

The present assemblies and methods for a fastener clamp are described in detail below with reference to these figures.

Figure 3:
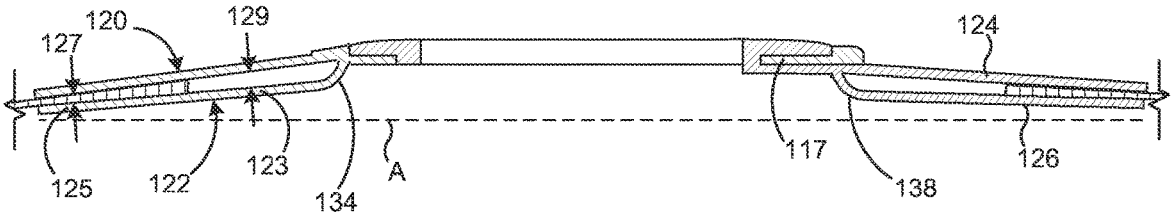

FIG. 3 a cross-sectional view of a fastener, in accordance with examples of this disclosure.

Figure 4:
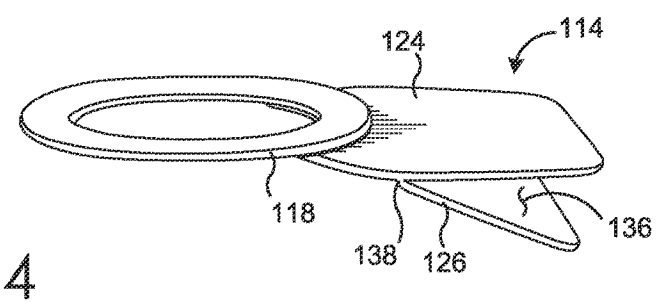

FIG. 4 depicts a first part of a fastener and a corresponding second part of a fastener, in accordance with examples of this disclosure.

Figure 5:
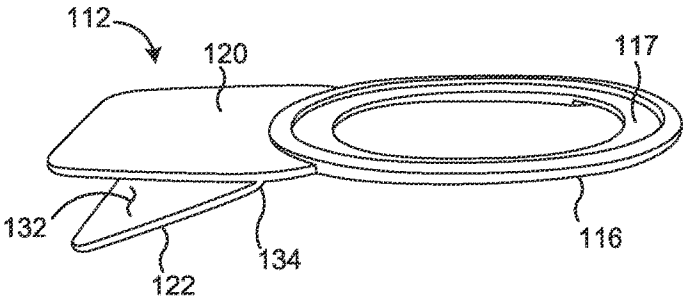
Figure 5:
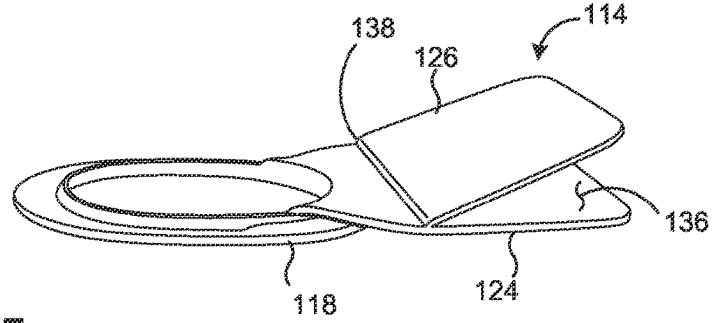

FIG. 5 depicts a bottom view of the fastener parts, in accordance with examples of this disclosure.

Figure 6:
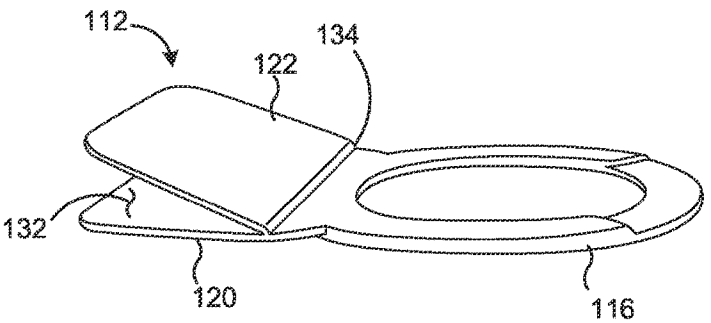
Figure 6:
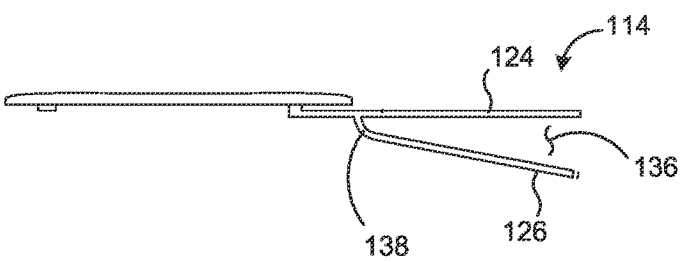
Figure 6:
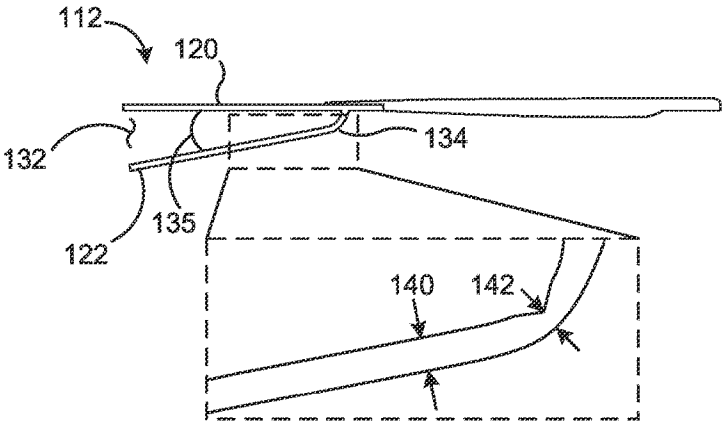

FIG. 6 depicts a side view of the fastener parts, in accordance with examples of this disclosure.

Figure 7A:
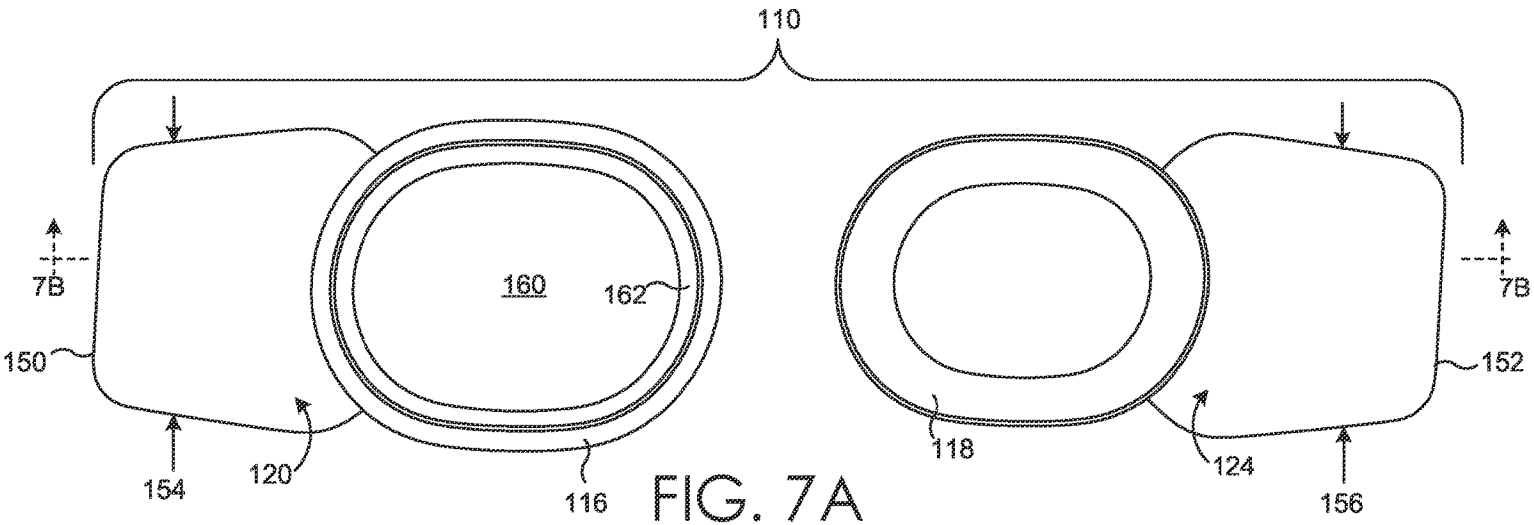

FIG. 7A depicts a plan view of the fastener parts, in accordance with examples of this disclosure.

Figure 7B:
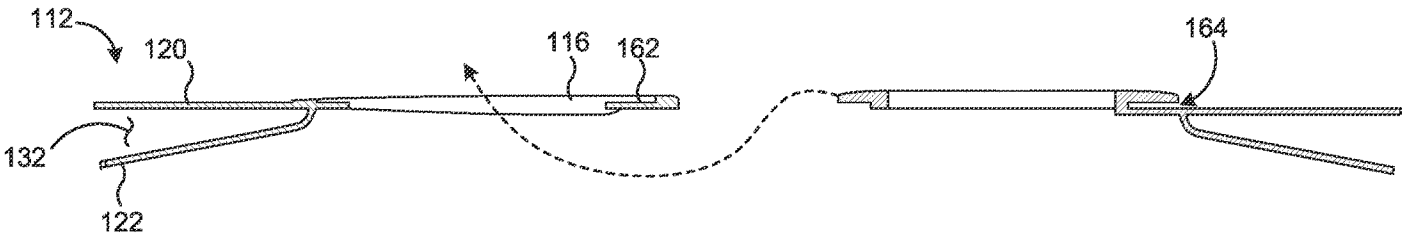
Figure 7C:
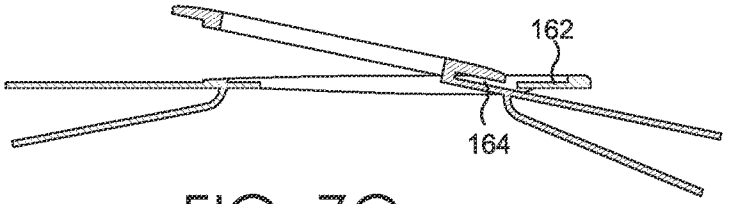
Figure 7D:
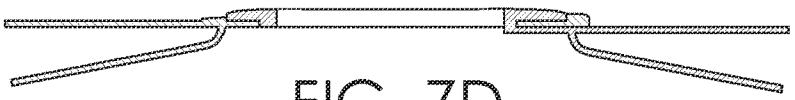

FIGS. 7B, 7C, and 7D depict the relative positions of the fastener parts, such as when the parts are being connected, in accordance with examples of this disclosure.

DETAILED DESCRIPTION

This detailed description is related to a clamp that can provide, for an associated fastener (e.g., hook and receiver or other male/female style fastener), a robust connection to a textile (e.g., a strap or other textile portion that is releasably attachable to another textile portion). For example, the fastener can include a first connector (e.g., hook) for releasably mating with a corresponding second connector (e.g., receiver). In addition, the first connector can include a clamp for providing a fixed connection to a first textile, and the second connector can include a clamp for providing a fixed connection to another textile (e.g., the first and second textiles to be releasably connected to each other via the fastener). In at least some examples, the clamp can include a first clamping plate and a second clamping plate. In addition, a portion of the textile can be secured in a clamping groove between the first clamping plate and the second clamping plate. For instance, the clamping plates can be bonded and/or stitched to the textile portion. Among other things, the clamp (e.g., including the clamping plates) can provide a robust connection that can withstand repeated wear, washing, etc. In addition, the clamp can include a relatively low profile. Further, when the connectors are mated, the clamps can contribute to spacing the connectors away from the wearer, which can reduce the likelihood that the connectors might rub or irritate or cause hot spots or other discomfort to the wearer.

Conventionally, fasteners have been fixedly coupled to a textile by various mechanisms that suffer from various drawbacks. For example, conventional mechanisms can, in some instances, fail to provide a sufficiently robust fixed connection, which can often fail after repeated wear, washing, or other normal use. In addition, some conventional mechanisms can damage the underlying textile through the use of teeth or other gripping structures. Further, fasteners that include conventional mechanisms can, in some instances, rub against the wearer or otherwise press upon the wearer, which can create irritation and discomfort.

Additional examples of the present disclosure are now described. Under various circumstances, it can be desirable to releasably connect a first textile portion (e.g., strap or textile panel or end of a strap or edge of textile panel) to a second textile portion (e.g., another strap or another textile panel or end of another strap or edge of another textile portion). For example, upper-torso support garments (e.g., sports bra, maternity bra, nursing bra, everyday bra, etc.) can include an underband that connects in the back. That is, the underband of the support garment can, for donning and doffing, disconnect in the back, and when being worn, can be connect for securement around the wearer. Often, the underband can include a fastener (e.g., hook, snap, button, hook-and-loop, other male/female connectors, etc.) in the back portion of the bra that facilitates the underband connecting and disconnecting. Examples of the present disclosure can include a clamp that can provide, for a releasable fastener, a fixed connection to a textile.

In at least some examples, the clamp can include, a first clamping plate and a second clamping plate, and the textile can be securely retained between the first and second clamping plates. In at least some examples, the first clamping plate can be affixed on one face of the textile, and the second clamping plate can be affixed on the opposing face of the textile, such that the body of the textile is positioned between the clamping plates. The first clamping plate and the second clamping plate can be coupled to the clamped textile portion by various mechanisms. For example, the first clamping plate can be bonded or adhered to a surface of the textile, and the second clamping plate can be bonded or adhered to the opposing surface of the textile. In addition, the clamp can include one or more other structures for securing the clamp to the textile, such as stitching, welding, heat stake, rivet, and the like.

In addition, in at least some examples, the fastener for attaching two textile portions (e.g., opposing portions of an underband in the back of an upper-torso support garment)

can include a connector (e.g., hook or receiver) and the first clamping plate and the connector can be positioned on a first side of the textile (e.g., an outer facing or exterior side of the textile). Further, the second clamping plate can be hingedly coupled to the first clamping plate and can be positioned on second side of the textile (e.g., an inner facing or interior side of the textile). In examples, the second clamping plate positioned on the second side can operate to position and/or bias the connector away from the wearer when the fastener is on a garment being worn. In at least some examples, the clamping plates can be drawn together (e.g., with stitches), and when the clamping plates are drawn together, the connector can biased in a direction away from the textile, which can increase the likelihood that the fastener can maintain a position apart from the wearer (e.g., to limit rubbing and irritation).

A clamp can include other features. For example, in some instances, the clamp can include a hinge that connects the second clamping plate to the first clamping plate. The hinge can include various elements. In one example, the hinge can include a thinned wall. For instance, the second clamping plate can include a first thickness and the hinge can include a second thickness, which is less than the first thickness. In examples, the thinned portion can include an integrally formed wall that is continuous with the second clamping plate, and as such, the clamp can be manufactured, such that the hinge is co-molded with the second clamping plate and/or the first clamping plate. In addition, the clamping plates can include various thicknesses and shapes. In some instances, the thickness of the clamping plate is relatively thin, which can contribute to a flexible or bendable hardware piece that can flex with motion and increase comfort. In some examples, the clamping plates can include a spade shape with a flattened distal terminal end. That is, the clamping plates can include a width that tapers in length as it extends to a terminal edge. Among other things, a tapered width can be less likely to include edges or corners that could cut into an article or a wearer.

In at least some examples, the fastener can include a hook and a receiver. The hook can include a clamp for fixed attachment to a first textile, and the receiver can include a clamp for fixed attachment to a second textile. The hook can include a throat for releasable attachment to an anchor portion of the receiver. In one example, the receiver includes a circular or ovular rim that has an open center forming a slot, and the hook can be inserted through the slot to engage the anchor portion in the throat. In at least some examples, the hook and the receiver can provide a secure, releasable connector that includes a relatively low profile and is comfortable to wear.

Some examples described herein are in the context of an upper-torso support garment (e.g. bra). In other examples, subject matter of this disclosure can include a clamp used with fasteners with other types of garments or equipment. For example, the clamp can be used with a fastener at the waistband of a lower-body garment to quickly couple textile elements together and to quickly adjust the circumferential diameter of the waistband. When incorporated into an article of footwear such as an upper of a shoe, the fastener with a clamp can be used to adjust the level of support across, for example, an instep region of the upper. A clamp of the present disclosure can also be used for a fastener that connects other portions of a bra, such as shoulder straps. These are just a few examples, and it is contemplated herein that the clamp of the present disclosure can be used with fasteners in any type of garment for which a quick and easy coupling and adjustment of support is desired. In addition, the clamp can be used with fasteners incorporated into various other articles, such as bags (e.g., backpacks, duffle bags, etc.).

In addition, some examples described herein include a fastener that includes a hook and a receiver, which releasably connect to one another. In addition, the hook can include a clamp for fixed attachment to a textile portion and the receiver can include a clamp for fixed attachment to a textile portion. A hook is one type of connector and a receiver is another type of connector. In some examples, the fastener can include other types of connectors, which can include a clamp for fixed attachment to a textile portion. For example, a connector can include a male connector and/or a female connector. A connector can include a threaded connection. A connector can include a snap, button, or a clip. A connector can include hook-and-loop strips. These are examples, and in other instances, a connector can include other connector types that include a clamp for fixed attachment to a textile.

As used herein, the term "garment" means any article that may be worn by a wearer. Example articles include support garments including bras and nursing bras, upper-body garments such as tops, pullovers, hoodies, jacket/coats, and the like, lower-body garments such as shorts, capris, leggings, pants, and the like, articles of headwear such as hats, caps, sweatbands, and the like, and articles of footwear including athletic shoes. The fastener can also be used in equipment such as backpacks, luggage, duffle bags, and the like.

Some positional terms might be used when describing the subject matter of this disclosure with the assumption that a subject item is being worn as intended by a wearer standing upright. For example, the term "inner" or "inward" can mean a layer or structure that is positioned closer to a body surface of a wearer as compared to other layers or structures of the garment. The term "outer" means a layer or structure that is positioned external to other layers or structures of the garment. In example aspects, an inner layer may be an innermost layer and an outer layer may be an outermost layer of the garment. An upper part of the garment would be located closer to a head area of a wearer compared to a lower part of the garment.

The term "support garment" when used herein refers to an upper-body garment primarily configured to provide support to a wearer's breasts. As such, the support garment can be in the form of a bra, including a nursing bra, pumping bra, and/or athletic bra, a tank top, an athletic top, a swimsuit top, and the like. When the garment is in the form of a support garment or bra, the term "breast-covering portion" means the portion of the support garment configured to cover a wearer's breast. As such, the breast-covering portion generally extends from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. The term "apex region" when referring to the support garment generally means the area where a shoulder strap extends from or is joined to the breast-covering portion or other portions of the support garment. The term "underband" when used in relation to, for instance, a bra refers to the portion of the bra that forms a lower margin of at least the front portion of the bra. The underband is configured to encircle the torso area of a wearer and may include a separate pattern piece or may include an integral extension of the front portion.

The term "strap" generally means an element having a greater length than width. In some examples, a strap includes at least some segment(s) along the length with parallel longitudinal side edges. In some examples, a strap can include some segments (e.g., end portions) with tapering longitudinal side edges (e.g., taper in width as the strap extends to a terminal end). The strap can be formed of textile elements (knit, woven, braided, nonwoven, and the like) or non-textile elements. In example aspects, the strap may be formed of a no-stretch or low-stretch material. A no-stretch or low-stretch material generally does not have inherent stretch properties (mechanical or elastic) in response to a tensioning force and thus the length and/or width of the material remains substantially unchanged when subject to the tensioning forces below the material's breaking/tearing point. For example, the strap may undergo a change of length from about 0% of resting length to about 20% of resting length in response to a tensioning force. The no-stretch or low-stretch material may include tightly knit, woven, or braided constructions that do not utilize elastic yarns; non-elastomeric films; knit, woven, nonwoven, or braided constructions that include a surface treatment to limit stretch, and the like.

As used herein, the term "about" means+/−10% of a subject term (e.g., quantity or other qualitative value). In addition, in some examples, size (e.g., lengths or widths) can be measured using a precision caliper.

The term "fixedly coupled" or "fixedly secured" generally means some type of permanent attachment through use of stitching, bonding, adhesives, welding, and the like. The term "slidably coupled" when referring to, for example, the receiver and a strap, means that the receiver can be moved (e.g., slid) along a length of the strap while maintaining the integrity of both the receiver and the strap. The term "releasably mated" or "releasably connected" (e.g., when referring to the relationship between the hook and receiver) means that the components can be repeatedly mated (i.e., joined together) and unmated without damaging either of the components.

Figure 1:
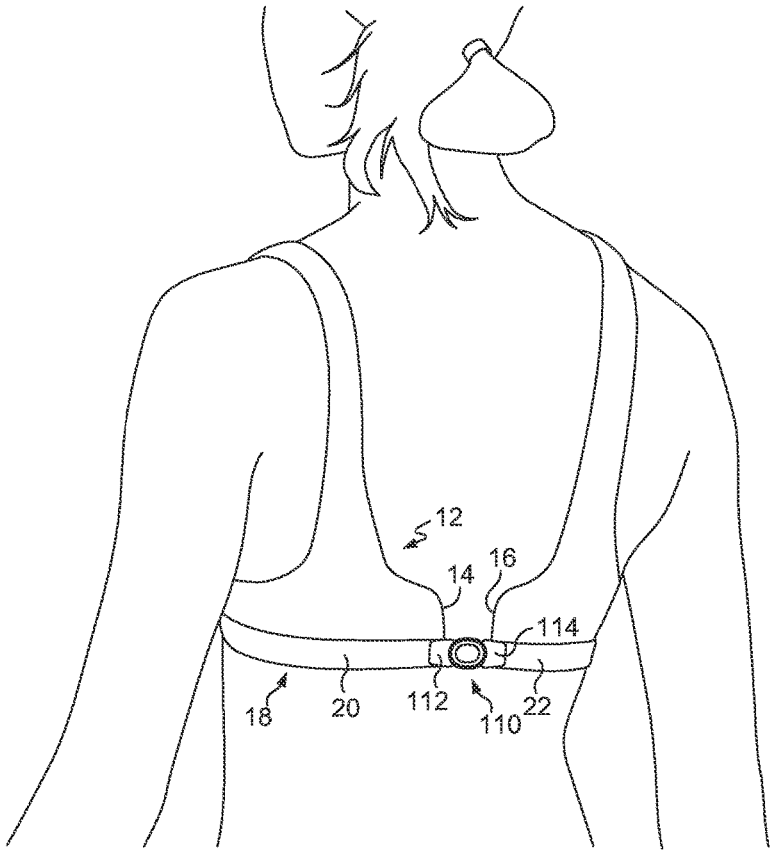
FIG. 1 depicts a back of an upper-torso support garment with a fastener, in accordance with examples of this disclosure.

Referring to FIG. 1, a back portion 12 of an upper-torso support garment is depicted, and the back portion 12 includes a first side 14 (e.g., left side) and a second side 16 (e.g., right side). In addition, the upper-torso support garment includes an underband 18 that extends around the back of the upper-torso support garment and that includes a first textile portion 20 (e.g., first end of a strap) and a second textile portion 22 (e.g., second end of a strap). In an example, a fastener 110 releasably connects the first textile portion 20 and the second textile portion 22. In addition, the fastener 110 includes a first connector (e.g., hook or other male-style connector) that releasably mates with a corresponding second connector, and the first and second connectors include a respective clamp 112 and 114 for secure connection to the first and second textile portions 20 and 22, respectively.

Figure 2:
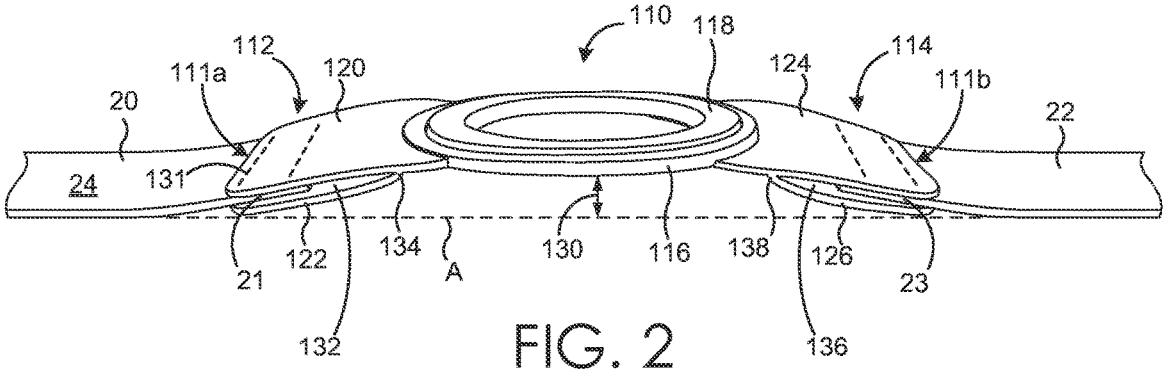
FIG. 2 depicts, from a lower perspective, a fastener connected to textile portions, in accordance with examples of this disclosure.

Referring to FIG. 2, a lower perspective view of the fastener 110 is depicted, together with the first textile portion 20 and the second textile portion 22. In addition, FIG. 2 includes a first connector 116 and a second connector 118 for releasably mating. In examples, the first connector 116 includes a receiver, and the second connector 118 comprises a hook, and the hook includes a throat for mating with an anchor portion of the receiver. In addition, in examples, the first connector 116 includes the first clamp 112 for secure attachment to the first textile portion 20, and the second connector 118 includes the second clamp 114 for secure attachment to the second textile portion 22.

In at least some examples, the first clamp 112 includes a first clamping plate 120 and a second clamping plate 122. In addition, the second clamp 114 can include a third clamping plate 124 and a fourth clamping plate 126. In at least some examples, the first clamp 112 and the second clamp 114 include a similar structure, and for brevity in this description, examples associated with the first clamp 112 might be described without describing the same or similar features of the second clamp 114—it is understood that those same features can be included with, and form part of, the second clamp 114. In at least some examples, the fastener 110 with the clamps 112 and 114 can extend in a direction away from the wearer. For example, FIG. 2 includes a reference line "A," which can represent an underlying surface (e.g., of an underlying garment or a wearer skin surface), and in examples, the fastener 110 with the clamps 112 and 114 is biased away from the underlying surface, as represented by the distance 130. In at least some examples, at least a portion of the fastener, when in a connected state (e.g., FIG. 2), can include an arcuate profile that extends from a first terminal end 111*a* to a second terminal end 111*b*.

In examples, the first clamping plate 120 and the second clamping plate 122 can form opposite sides of a clamping groove 132, which is configured to retain a clamped segment 21 of the first textile portion 20. For example, the first textile portion 20 (and the clamped segment 21) can include an outer surface 24 that faces away from the wearer and an inner surface (obscured from view in the figures), and the first clamping plate 120 can be affixed to the outer surface 24, while the second clamping plate 122 can be affixed to the inner surface.

At least some portions of the fastener 110 can include relative positions that contribute to the operation of the fastener 110. For example, in some instances the first connector 116 (e.g., receiver) includes a portion 117 (e.g., see FIG. 3 showing an anchor portion along the rim) that is configured to mate with the second connector 118 (e.g., see FIG. 3 showing a throat of the hook). In some examples, the portion 117 is positioned further outward (e.g., further away from the reference line A) than the second clamping plate 122 and/or the clamped segment 21. In some examples, this positioning can position parts of the fastener away from the wearer to reduce a likelihood that the fastener can rub or otherwise cause discomfort.

In addition, referring also to FIGS. 4, 5, and 6, in examples, the first clamping plate 120 and the second clamping plate 122 can be connected by a hinge 134, and via the hinge 134, the second clamping plate 122 can rotate towards the first clamping plate 120 and be secured to the clamped segment 21 and/or the first clamping plate 120 to securing retain the clamped segment 21 in the clamping groove 132. Similar to the first clamp 112, the third clamping plate 124 and the fourth clamping plate 126 can form opposite sides of a clamping groove 136, which is configured to retain a clamped segment 23 of the second textile portion 22. In addition, the third clamping plate 124 and the fourth clamping plate 126 can be connected by a hinge 138.

The hinges 134 and 138 can include various structures. For example, in one example, the hinges 134 and 138 can include a wall that is thinner than other portions of the clamping plates, and the thinner wall can operate as a living hinge. Referring to FIG. 6, an enlarged view 510 of the hinge 134 is depicted, and in one example, the second clamping plate 122 includes a first thickness 140 and the hinge 134 includes a second thickness 142, which is less than the first thickness 140.

In at least some examples, the first clamping plate 120 and the second clamping plate 122 are oriented, via the hinge 134 and prior to connection to a textile portion, at an angle 135 with respect to one another. For example, the angle 135 can include an angle in a range of about 15 degrees to about 65 degrees, or about 30 degrees to about 50 degrees, or about 45 degrees. These angles are examples and in other instances, the angle 135 can be smaller or larger than these examples. In some examples, the angular orientation of the first clamping plate 120 and the second clamping plate 122 can, when the first clamping plate 120 and the second clamping plate 122 are compressed towards one another (e.g., when clamping onto a textile portion), create a tension force that biases the connector 116 away from the wearer.

In at least some examples, the second clamping plate 122 can include a proximal portion 123 and a distal portion 125, the proximal portion 123 being closer (relative to the distal portion 125) to the hinge 134. In addition, in some examples, the proximal portion 123 is, relative to the distal portion 125, spaced apart from the first clamping plate 120 by a larger gap. For example, referring to FIG. 3, FIG. 3 depicts a distal portion 125, which is spaced apart from the first clamping plate 120 by a first distance 127, and a proximal portion 123, which is spaced apart from the clamping plate 120 by a second distance 129. In some instances, the first distance 127 can be smaller than the second distance 129. For example, if stitches (e.g., 131) are used to secure the clamping plates to the textile portion, then the stitches affixed near the distal portion can help pull the distal portion closer to the first clamping plate 120. In some examples, retaining the distal portion closer to the first clamping plate can create tension in the fastener 110, which can bias the fastener outward when in a connected state.

A clamp can, in examples of the present disclosure, include various other features. For example, the clamp can, in some instances, be co-molded with a connector, such that the connector and the clamp include a continuous body (e.g., monolithic). In some examples. The clamp can include various materials including a thermoplastic (e.g., thermoplastic polyurethane or TPU). In some examples, the first clamping plate can include various features. For example, the clamping plates can include a thickness that is configured to provide a robust anchor for a stitch, while also being flexible to bend (e.g., when in use or when being manipulated for fastening). In at least some examples, the clamping plates can include a smooth surface. In some examples, the clamping plates can include one or more surface features (e.g., ridges or raised features) to facilitate gripping the clamping plate (e.g., where the clamping plate can be used as a handle to manipulate the connector).

Referring to FIG. 7A, a plan view is depicted of the fastener 110, which includes the first clamping plate 120 associated with the first connector 116 (e.g., receiver) and the third clamping plate 124 associated with the second connector 118 (e.g., hook). In at least one example, the first clamping plate 120 and the second clamping plate 122 can include a distal end 150 and 152, respectively. In addition, in examples, the first clamping plate 120 and the second clamping plate 122 can taper in width (e.g., 154 and 156 respectively), as they extend to the distal end. Among other things, tapering in width can, in some instances, reduce the presence of protruding edges or corners that can catch or snag or cause discomfort to a wearer.

FIGS. 7A through 7D include, in accordance with an example, the first connector 116, which can include a receiver for mating with a hook of the second connector 118. For example, the first connector 116 can include an opening 160, such as a slot or eyelet, for receiving a portion of second connector 118 (e.g., a portion of the hook). In addition, the first connector 116 can include an anchor portion 162 for securement in a throat or other female style connector. In addition, the second connector 118 can include hook elements that correspond with the first connector 116. For example, the second connector 118 can include a throat 164 for engaging the anchor portion 162 of the first connector 116.

In examples, to connect the fastener 110, the second connector 116 can be inserted through the opening 160. As an illustration, FIG. 7B includes an arrow 166 that shows an example travel path of the front tip of the second connector through the opening 160, and FIG. 7C illustrates the second connector 118 and the first connector 116 after the second connector 118 is positioned in the opening 160. In addition, after the second connector 118 is positioned in the opening 160 (e.g., after the throat 164 is traversed beyond the anchor portion 162) the second connector 118 and the first connector 116 can be connected, as shown in FIG. 7D, by inserting the anchor portion 162 into the throat 164.

Example Clauses

Clause 1. An upper-torso support garment comprising: an underband comprising at least part of a back portion of the upper-torso support garment, the underband comprising a first textile portion and a second textile portion; a fastener configured to releasably connect the first textile portion to the second textile portion, the fastener comprising a hook and a receiver; the receiver comprising a first clamp, which comprises a first clamping plate affixed to an outer side of the first textile portion and a second clamping plate affixed to the inner side of the first textile portion, wherein a first clamped portion of the first textile portion is retained between the first clamping plate and the second clamping plate; and the hook comprising a second clamp, which comprises a third clamping plate affixed to an outer side of the second textile portion and a fourth clamping plate affixed to the inner side of the second textile portion, wherein a second clamped portion of the second textile portion is retained between the third clamping plate and the fourth clamping plate.

Clause 2. The upper-torso support garment of Clause 1, wherein a portion of the receiver that mates with the hook is, relative to the first clamped portion, positioned further outward.

Clause 3. The upper-torso support garment of Clause 1 or 2, wherein the second clamping plate is attached, via a hinge, to the first clamping plate.

Clause 4. The upper-torso support garment of any of Clauses 1 through 3, wherein: the second clamping plate comprises a proximal portion and a distal portion, the proximal portion being closer, relative to the distal portion, to the hinge; and the proximal portion is, relative to the distal portion, spaced apart from the first clamping plate by a larger distance.

Clause 5. The upper-torso support garment of any of Clauses 1 through 4, wherein the first clamping plate and the second clamping plate are one or more of bonded or stitched to the first clamped portion.

Clause 6. The upper-torso support garment of any of Clauses 1 through 5, wherein the hook and the receiver, when connected to each other, bow outward.

Clause 7. The upper-torso support garment of any of Clauses 1 through 6, wherein: the first clamping plate comprises a proximal portion and a distal portion, the proximal portion being closer, relative to the distal portion, to a portion of the receiver that mates with the hook; and the first clamping plate tapers in width as the first clamping plate extends from the proximal portion to the distal portion.

Clause 8. A fastener comprising: a hook and a receiver that releasably connect to one another; the hook comprising a first clamp, which comprises a first clamping plate configured to be affixed to a first side of a first textile portion and a second clamping plate configured to be affixed to a second side of the first textile portion; and the receiver comprising a second clamp, which comprises a third clamping plate configured to be affixed to a first side of a second textile portion and a fourth clamping plate configured to be affixed to a second side of the second textile portion.

Clause 9. The fastener of Clause 8, wherein: the second clamping plate is attached, via a first hinge, to the first clamping plate; and the third clamping plate is attached, via a second hinge, to the fourth clamping plate.

Clause 10. The fastener of Clause 8 or 9, wherein: the second clamping plate comprises a first thickness and the first hinge comprises a second thickness that is less than the first thickness; and the fourth clamping plate comprises a third thickness and the second hinge comprises a fourth thickness that is less than the third thickness.

Clause 11. The fastener of any of Clauses 8 through 10, wherein: the first clamping plate comprises a proximal portion and a distal portion, the proximal portion being closer, relative to the distal portion, to a portion of the hook that mates with the receiver; and the first clamping plate tapers in width as the first clamping plate extends from the proximal portion to the distal portion.

Clause 12. The fastener of any of Clauses 8 through 11, wherein: the third clamping plate comprises a proximal portion and a distal portion, the proximal portion being closer, relative to the distal portion, to a portion of the receiver that mates with the hook; and the third clamping plate tapers in width as the third clamping plate extends from the proximal portion to the distal portion.

Clause 13. The fastener of any of Clauses 8 through 12, wherein: the clasp releasably connects a first portion of an article to a second portion of the article; and the article includes an upper-torso garment, a pant garment, a belt, a footwear article, or a bag.

Clause 14. A fastener comprising: a first connector that releasably mates with a second connector; the first connector comprising a clamp configured to attach to a textile portion; the clamp comprising a first clamping plate and a second clamping plate; and the first clamping plate and the second clamping plate comprising opposing sides of a clamping groove configured to receive a segment of the textile portion.

Clause 15. The fastener of Clause 14, wherein the second clamping plate is attached, via a hinge, to the first clamping plate.

Clause 16. The fastener of Clause 15, wherein: the second clamping plate comprises a first thickness; and the hinge comprises a second thickness that is less than the first thickness.

Clause 17. The fastener of any of Clauses 14 through 16, wherein: the first clamping plate comprises a first proximal portion and a first distal portion, the first proximal portion being closer, relative to the first distal portion, to a portion of the connector that mates with the second connector; the first clamping plate tapers in width as the first clamping plate extends from the first proximal portion to the first distal portion; the second clamping plate comprises a second proximal portion and a second distal portion, the second proximal portion being closer, relative to the second distal portion, to a portion of the second clamping plate that connected to the first clamping plate; and the second clamping plate tapers in width as the second clamping plate extends from the second proximal portion to the second distal portion.

Clause 18. The fastener of any of Clauses 14 through 17, wherein the fastener releasably connects a first portion of a support-garment underband to a second portion of a support-garment underband.

Clause 19. A fastener comprising: a first connector that releasably mates with a second connector; the first connector comprising a clamp configured to attach to a textile portion; the clamp comprising a first clamping plate and a second clamping plate; and the second clamping plate being angled, at an angle, relative to the first clamping plate.

Clause 20. The fastener of Clause 19, wherein the angle is in a range of about degrees to about 65 degrees.

Clause 21. The fastener of Clause 19 or 20, wherein the second clamping plate is coupled directly to the first clamping plate.

Clause 22. The fastener of any of Clauses 19 through 21, wherein the second clamping plate is coupled, via a hinge, to the first clamping plate.

Clause 23. The fastener of any of Clauses 19 through 22, wherein: the first clamping plate and the second clamping plate comprise opposing sides of a clamping groove configured to receive a segment of the textile portion; and the first clamping plate includes one or more raised surface features on a surface exterior to the clamping groove.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A fastener comprising:

a hook and a receiver that releasably connect to one another;

the hook comprising:

a first clamp, the first clamp comprising:

a first clamping plate configured to be affixed to a first side of a first textile portion; and a second clamping plate configured to be affixed to a second side of the first textile portion; and the receiver comprising:

a rim surrounding an aperture, the aperture being configured to receive the hook; and a second clamp, the second clamp comprising:

a third clamping plate configured to be affixed to a first side of a second textile portion; and a fourth clamping plate configured to be affixed to a second side of the second textile portion, wherein the hook and the receiver are spaced away from an underlying surface when the hook is received by the receiver, the first clamping plate and the second clamping plate extending downwardly towards the underlying surface and away from the receiver when the hook is received by the receiver, and the third clamping plate and the fourth clamping plate extending downwardly towards the underlying surface and away from the hook when the hook is received by the receiver.

2. The fastener of claim 1, wherein:

the second clamping plate is attached, via a first hinge, to the first clamping plate; and the third clamping plate is attached, via a second hinge, to the fourth clamping plate.

3. The fastener of claim 2, wherein:

the second clamping plate comprises a first thickness and the first hinge comprises a second thickness that is less than the first thickness; and the fourth clamping plate comprises a third thickness and the second hinge comprises a fourth thickness that is less than the third thickness.

4. The fastener of claim 1, wherein:

the first clamping plate comprises a proximal portion and a distal portion, the proximal portion being closer, relative to the distal portion, to a portion of the hook that mates with the receiver; and the first clamping plate tapers in width as the first clamping plate extends from the proximal portion to the distal portion.

5. The fastener of claim 1, wherein:

the third clamping plate comprises a proximal portion and a distal portion, the proximal portion being closer, relative to the distal portion, to a portion of the receiver that mates with the hook; and the third clamping plate tapers in width as the third clamping plate extends from the proximal portion to the distal portion.

6. The fastener of claim 1, wherein:

the fastener releasably connects a first portion of an article to a second portion of the article; and the article includes an upper-torso garment, a pant garment, a belt, a footwear article, or a bag.

7. The fastener of claim 1, wherein the hook further comprises a second aperture, and wherein, when the hook is inserted into the aperture of the receiver, the second aperture of the hook and the aperture of the receiver are axially aligned.

8. The fastener of claim 7, wherein the second aperture of the hook and the aperture of the receiver are centered around a common central point when axially aligned.

9. A fastener comprising:

a first connector that releasably mates with a second connector;

the first connector comprising a clamp configured to attach to a textile portion, and a hook configured to releasably mate with the second connector;

the clamp comprising a first clamping plate extending from the hook to a first free end having a first end and a second end and a second clamping plate extending from the first clamping plate to a second free end having a first end and a second end; and the first clamping plate and the second clamping plate comprising opposing sides of a clamping groove configured to receive a segment of the textile portion, wherein the first end of the second clamping plate is joined to the first clamping plate between the hook and the first free end, wherein the first clamping plate and the second clamping plate extend downwardly toward an underlying surface and away from the second connector when the hook is mated with the second connector at an intermediate point of the first clamping plate between the first end and the second end of the first clamping plate, and wherein the fastener is offset from the underlying surface.

10. The fastener of claim 9, wherein the second clamping plate is attached, via a hinge, to the first clamping plate.

11. The fastener of claim 10, wherein:

the second clamping plate comprises a first thickness; and the hinge comprises a second thickness that is less than the first thickness.

12. The fastener of claim 9, wherein:

the first clamping plate comprises a first proximal portion and a first distal portion, the first proximal portion being closer, relative to the first distal portion, to a portion of the first connector that mates with the second connector, the first clamping plate tapers in width as the first clamping plate extends from the first proximal portion to the first distal portion;

the second clamping plate comprises a second proximal portion and a second distal portion, the second proximal portion being closer, relative to the second distal portion, to a portion of the second clamping plate that connected to the first clamping plate; and the second clamping plate tapers in width as the second clamping plate extends from the second proximal portion to the second distal portion.

13. The fastener of claim 9, wherein the fastener releasably connects a first portion of a support-garment underband to a second portion of the support-garment underband.

14. The fastener of claim 9, wherein the second clamping plate extends from the underlying surface to the intermediate point on the first clamping plate.

15. A fastener comprising:

a first connector that releasably mates with a second connector;

the first connector comprising a first clamp configured to attach to a textile portion and a body having a first elongated cross-sectional profile defined by a first diameter and a second diameter, wherein the first diameter is different than the second diameter;

the second connector comprising a second clamp configured to attach to another textile portion and a rim defining an aperture having a second elongated cross-sectional profile defined by a third diameter and a fourth diameter, wherein the third diameter is different than the fourth diameter, wherein the body of the first connector is configured to be inserted into the aperture of the second connector in a first rotational orientation and rotated into a second rotational orientation such that the first and second elongated cross-sectional profiles are axially aligned to secure the fastener in a closed position, wherein the body and the rim are spaced away from an underlying surface when the body is received by the rim, the first clamp extending downwardly towards the underlying surface and away from the rim when the body is received by the rim, and the second clamp extending downwardly towards the underlying surface and away from the body when the body is received by the rim.

16. The fastener of claim 15, wherein each of the clamps comprise a first clamping plate and a second clamping plate, and wherein the second clamping plate is angled at an angle that ranges from 15 degrees to 65 degrees.

17. The fastener of claim 16, wherein the second clamping plate is coupled, via a hinge, to the first clamping plate.

18. The fastener of claim 15, wherein:

the first diameter is greater than the second diameter;

the third diameter is greater than the fourth diameter;

the third diameter is greater than the first diameter; and the fourth diameter is less than the second diameter.

* * * * *